US005641004A

United States Patent [19]

Py

[11] Patent Number: 5,641,004

[45] Date of Patent: Jun. 24, 1997

[54] PROCESS FOR FILLING A SEALED RECEPTACLE UNDER ASEPTIC CONDITIONS

[76] Inventor: Daniel Py, 40 rue Franklin, 78100 St. Germain En Laye, France

[21] Appl. No.: 424,932

[22] Filed: Apr. 19, 1995

[30] Foreign Application Priority Data

Apr. 26, 1994 [FR] France ..... 94 05011

[51] Int. Cl.[6] ..... B65B 1/04; B65B 3/04

[52] U.S. Cl. ..... 141/3; 141/10; 141/98; 141/114; 141/313; 141/329; 53/403

[58] Field of Search ..... 141/1, 10, 65, 141/85, 92, 93, 98, 114, 313, 326, 329, 349, 59; 53/403, 405, 469, 88, 97, 434, 512, 269, 268, 79; 600/21, 22; 454/49, 56, 66, 67

[56] References Cited

U.S. PATENT DOCUMENTS

| | | | |
|---|---|---|---|
| 2,503,147 | 4/1950 | Applezweig . | |
| 2,855,006 | 10/1958 | Geisler | 141/7 |
| 3,340,671 | 9/1967 | Loo | 141/329 |
| 3,685,248 | 8/1972 | Godelaine . | |
| 4,250,611 | 2/1981 | Wong | 141/329 |
| 4,703,781 | 11/1987 | Meyer et al. | 141/5 |
| 4,842,028 | 6/1989 | Kaufman et al. | 141/114 |
| 5,129,212 | 7/1992 | Duffey et al. | 141/10 |
| 5,341,854 | 8/1994 | Zezulka et al. | 141/114 |
| 5,411,065 | 5/1995 | Meador et al. | 141/114 |

FOREIGN PATENT DOCUMENTS

| | | |
|---|---|---|
| 2509689 | 7/1981 | France . |
| 500354 | 2/1939 | United Kingdom . |

*Primary Examiner*—Renee S. Luebke
*Assistant Examiner*—Steven O. Douglas
*Attorney, Agent, or Firm*—Kenyon & Kenyon

[57] ABSTRACT

An automated process for filling a sealed receptacle (1) with a fluid under aseptic conditions is disclosed. The sealed receptacle has at least one part (2B) made of a material capable of being pierced by a hollow needle (8R) and sufficiently flexible to close itself up again after removal of the hollow needle. In the automated process, the part (2B) of the sealed receptacle is pierced using a hollow filling needle (8R) which is in contact with the fluid to be channeled into the receptacle (1). During the process of filling the receptacle (1), the perforating end of the hollow filling needle (8R) is maintained under aseptic conditions by means of laminar gas flow.

13 Claims, 3 Drawing Sheets

PROCESS FOR FILLING A SEALED RECEPTACLE UNDER ASEPTIC CONDITIONS

The present invention relates to an industrial process for filling a sealed receptacle under aseptic conditions.

The problem of industrial filling, under aseptic conditions, of a receptacle using a fluid, and at a high rate, is of extreme importance in certain industries, in particular in the pharmaceutical industry.

In fact, in medicine, the injection of a sample with a fluid containing pathogenic living organisms can have dramatic consequences.

A device and process are already known from FR-A-2, 509,689 for ensuring the aseptic transfer of a liquid contained in a receptacle to another receptacle, in which the receptacle to be filled is inserted into a sealed cylindrical chamber and into which steam is injected by means of a hypodermic needle to create the asepsis. In this way one flask per half hour can be filled using a given needle.

U.S. Pat. No. 2,555,066 describes a process for filling a drink receptacle using a double-needle injector, the sterility of the inside of the receptacle being created by the injection of steam.

The displacement of the evacuation needle relative to the filling needle makes filling without a gaseous residue (called "airless") impossible.

WO-A-85/05269 describes a manufacturing process for a syringe pre-filled with a unit dose as well as a device for implementing this process in which the gassing of a cartridge and optionally of an injector is carried out creating, inside a cavity completely containing the cartridge, a gas current circulating upwards flushing the outer sides of the cartridge and causing a flush gas to flow through the channels of the injector.

This is why it is still being sought to provide maximum safety for filling a receptacle intended to deliver unit or multiple and repeated doses of products which in particular have no preservative.

It is clear that the greater the number of doses to be subsequently delivered, the more important it is that the filling should be carried out with the maximum of precautions, especially during high rate filling operations.

For certain products, it proves to be very useful or indispensable, both for questions of preservation or possible degradation and for reasons of hygiene, to avoid any contact of the fluid with air during the filling phase.

It would also be desirable not to expose the desired fluid, such as a pharmaceutical product, to a sudden variation in temperature nor to any gas whatsoever during any stage of filling of a receptacle.

It would also be desirable for filling to be carried out under such conditions that the variations in temperature or in ambient pressure of the premises during the filling procedure, do not influence the dose of medicament delivered into the receptacle, and consequently the dose or doses delivered subsequently by the receptacle.

It would again also be desirable to have available disposal a process allowing filling without residual gas in the receptacle.

Finally filling should if possible be carried out in a premises where the ambient air is not necessarily aseptic.

This is why a subject of the present Application is an automated process for filling a sealed receptacle with a fluid, under aseptic conditions, characterized in that said receptacle has at least one part made of a material capable of being pierced through with a hollow needle and sufficiently flexible to close itself up enough again after removal of the hollow needle, and sterilized beforehand, in which:

said part is pierced with a hollow filling needle, connected to the fluid, filling of the recipient is proceeded with, the end of the hollow filling needle being, during these operations, maintained under aseptic conditions using a laminar flow.

The sealed receptacle can be of any type; it can be for example a glass flask sealed with a rubber stopper itself closed by a cap, for example of metal, a completely pierceable receptacle, preferably a bag of plastic material such as rubber, either filled with gas or with a mixture of gases, or itself substantially evacuated of gas and thus being presented in the form of a collapsed tube, said bag being for example produced entirely from the same material, in a single piece, or any other sort of receptacle insofar as it has at least one part made of a material capable of being pierced by a hollow needle and sufficiently flexible to close itself up enough again after the said hollow needle has been removed so that sealing can be performed through a minimum of leaking liquid.

The receptacle is quite particularly a plastic bag, having one part made of material capable of being pierced situated laterally, said part preferably being thicker than the rest of the envelope.

The sealed receptacle can be optionally partially filled with another fluid or with a fluid of the same type.

For example the rubber stopper of a glass flask in particular for an injectable preparation, corresponds to a part or area of access, as mentioned above.

The expression "to close itself up again" means that the inside of the receptacle becomes substantially inaccessible to gases such as air, and to particles such as microorganisms, bacteria and viruses.

All of the receptacle or the outside of the receptacle can be constituted by such a material.

The receptacle can be for example and preferably a bag, filled with gas or on the contrary evacuated of gas, constituted by a flexible material such as an elastomer, KRATON® (hydrogenated, block/triblock, isoprene-styrene rubber), rubber, etc . . . , and for example obtained from an elongated tube notably heat sealed and cut up at regular intervals. The receptacle is quite particularly the one described hereafter in the experimental part. One part of such a bag can be specially designed to be pierced by the hollow needle. This particular design can be notably a local thickening of the material of which the bag is constituted, preferably placed laterally.

Such a thickening constitutes for example in particular a safe means for obtaining a perfect closure after removal of the needle and furthermore can facilitate the outcome that one side of said bag can be pierced during the introduction of the hollow filling needle, in a single place, without the risk of undesirable piercing for example of the opposite side.

The material capable of being pierced by a hollow needle and sufficiently flexible to close itself up as much as possible again after removal of the latter can be for example a plastic material, or a rubberized material such as rubber or elastomer, in particular KRATON® (hydrogenated, block/triblock, isoprene-styrene rubber).

As is apparent to a man skilled in the art, the thickness of the material in the penetration area will be sufficient to ensure that the bag effectively closes itself up as much as possible again after removal of the needle and thick enough to allow an efficient seal even in the case of a possible leak. This thickness will be, in practice, chosen in proportion to the diameter of the needle used and inversely proportional to the degree of elasticity of the material.

For receptacles having the size of those generally used in the pharmaceutical and medical domain, this thickness will be of the order of 2 mm. There is obviously no real upper limit other than that required by the solidity of the hollow needles taking into account the thickness that they have to penetrate.

The process according to the present invention is preferably implemented with a filling rate of at least one flask every 10 seconds and preferably one flask every 2 seconds and in particular one flask per second. What is meant by this is that the same filling needle for example is responsible for filling a new flask every second.

This closure is preferably completed using a technique well-known to a man skilled in the art, such as the application of a heating element, clamp or plug for example, creating a fusion at the site of the penetration. Advantageously, this closure will be achieved by means of one or more laser beams aimed at the site of the penetration. In this way, the energy necessary for the fusion of the material of which said part is constituted is limited to the site of the penetration only.

Under the preferred conditions of the process described above, the filling needle (and optionally evacuation needle as will be seen hereafter) is removed and the sealing of the penetration(s) is proceeded with quickly, preferably immediately.

The receptacle can be of any configuration such as for example a flask, vial, bottle, bag or pouch.

The hollow filling needle which can be used is well known to a man skilled in the art; it is for example of the type of those commonly used in particular for administering injectable preparations to man, but with a large diameter, namely 0.6 to 3 mm and in particular 0.8 to 2 mm. The opening of the needle through which the fluid flows can also be lateral.

A needle <<non coring>> or Huber point type needle will preferably be used of the type which does not remove material like "a punch" or is likely to generate the formation of particles, known to a man skilled in the art.

The inside of the hollow needle will be in fluid communication with the fluid with which it is desired to fill the receptacle. The injected fluid can be either a solution or a suspension, or perhaps a gel or even a gas.

The filling of the receptacle is then carried out according to the methods well known to a man skilled in the art, preferably automatically, assisting the injection for example by a controlled and transitory pressure. In order to improve filling by avoiding the formation of bubbles, the filling operation can for example and preferably be carried out on a vibrating table.

An essential characteristic of the process described above is that the perforating end of the hollow filling needle is, during all these operations, maintained under aseptic conditions which can be obtained in particular by pulsion, at least in the area of the point of the needle, of a flow of gas, in particular of air as a laminar flow. Laminar flows are well known from the state of the art.

A laminar flow is, as is known, freed, using at least one microfilter or sterilizing filter, from any elements with a size which is below the threshold of the chosen filter.

Preferably, the assembly of a filling unit combining the filling needle and the receptacle receiving the flask during filling, will be subjected to the laminar flow.

As can be seen from what precedes, if desired only a small surface of the fluid, that of the opening at the perforating end of the hollow filling needle, comes into contact with a gas; the latter will usually be air coming from the laminar flow generator.

However, this laminar flow generator can be supplied with any gas, for example an inert gas in the case where even a minimal and brief contact of the fluid with the air could have unfavourable consequences.

In addition a gaseous current of hydrogen peroxide (H202) can also be supplied to the end of the filling and aspiration needles.

In most cases, in particular when the inside of the receptacle will not be substantially under vacuum, it will be preferable to eliminate all or part of the fluid which may already exist in the sealed receptacle. Usually this fluid will be air.

This is why a subject of the present invention is also a filling process as defined above characterized in that the sealed receptacle contains, before filling, another fluid such as a gas or a mixture of gases and in that in addition a part made of a material capable of being pierced by a hollow needle and sufficiently flexible to close itself up again after removal of the hollow needle is pierced with a hollow evacuation needle; said part can be identical to or preferably separate from that used during filling.

Penetration using the hollow evacuation needle, the latter being able to be of the same type as that used for the filling, with an optionally smaller inner diameter, will allow the fluid already existing in the receptacle to be evacuated. If desired, this evacuation can be obtained due to the simple injection of the filling fluid into the receptacle. It may also be preferred to assist this evacuation using for example an evacuation device, preferably in synchronization with the filling, such as a pump. The evacuation could take place before, during or after the filling.

The evacuation needle will preferably be separate from and at least 1 mm, preferably at least 5 mm, and quite particularly at least 10 mm, distant from the one for filling.

Under other preferred conditions for implementing the process described above, the filling needle is, during the filling operation, in a lower position than that of the evacuation needle; their distance apart is preferably about that mentioned above. In this way filling can be carried out without there being any residual gas in the receptacle, called "airless" filling.

In this case, the penetration used for the evacuation is preferably carried out near to one end of the receptacle, this end being chosen in such a way as to be the highest point of the receptacle during filling.

Under yet another set of preferred conditions for implementing the process described above, the perforating end of the hollow evacuation needle is also maintained under aseptic conditions.

As is understood from what precedes, since the end of the needle or needles is maintained under aseptic conditions, these aseptic conditions also apply to the penetration point of the receptacle at least at the moment of filling.

However, it is preferable that the aseptic conditions are applied both to the site or sites of penetration of the receptacle, and to the end of the hollow needle or needles in the cases where the asepsis conditions require it, that is to say, in other words, to the area of the critical interfaces.

As is apparent to a man skilled in the art, in the cases where it is desired not only to minimize contact between the fluid with which the receptacle will be filled and the air, or other gases, but also to obtain a receptacle containing a sterile fluid, the inside of the sealed receptacle which it is desired to fill is itself sterile. This asepsis can be achieved by the processes well known to a man skilled in the art; for example according to the nature of all or part of the receptacle, by radiation, in particular gamma, beta radiation, using ethylene oxide, ultra-violet, an electron beam, etc . . .

This sterilization could, if desired, be carried out on a production line between the assembly of the receptacle and its filling.

In this respect, means indicating that the sterilization is satisfactory could also be used, for example colorimetric indicators sensitive to radiation and well known to a man skilled in the art.

As is understood from what precedes, the process described above is particularly useful when the filling fluid is a liquid, in particular a sterile liquid, which contains no preservative, or a fragile liquid, subjected to risks of degradation, in particular on contact with air or heat.

During the filling operation, the position of the needles and the receptacle will be determined according to the desired objective.

If this is of lesser importance, when it is desired for example to fill a bag which is substantially under vacuum, the position of the needle or needles can have a significant influence on the result obtained during filling, in such a way for example as to ensure the elimination of all or almost all of the fluid already existing in the receptacle.

As can be easily imagined, and as has been seen above, an optional evacuation will take place for example near to the top of the receptacle.

A succession of stages for filling a receptacle can be for example the following: installation of the receptacle, activation of the pump, introduction of the hollow needles into the part or parts of the receptacle suitable for this purpose, opening of the evacuation needle, opening of the filling needle, filling, closing of the evacuation needle, removal of the needles, and if desired sealing of the evacuation and filling holes.

The above stages illustrate the case of the use of a pump, which can be used both for the evacuation and to accelerate filling and in the case where two needles are used, one for the introduction of the fluid and the other for the evacuation of the fluid, such as air, already existing in the receptacle.

These operations will of course have been carried out after starting the laminar flow generator and obtaining the asepsis of the desired areas (operating surface or enclosure, critical interfaces . . . ).

If desired, the perforating end of the evacuation needle can be fitted with a detector sensitive to liquids, such that both the filling and the evacuation functions are stopped when the filling level thus detected is reached.

Also a subject of the present invention is a process characterized in that in addition the closure at the site or sites perforated by the hollow needle is completed, preferably by hot sealing or using a laser beam.

Also a subject of the present invention is an installation for the implementation of the process as described above, characterized in that it comprises a generator of a laminar gas flow active over at least the perforating end of a filling needle, a retention means during filling of a receptacle intended to be filled with a fluid, a motorized hollow filling needle, if desired a motorized hollow evacuation needle, its movements synchronized with the hollow filling needle, motorized means 21 for actuating the hollow filling needle in the direction of the retention means of the receptacle, a supply of filling fluid in fluid communication with the hollow filling needle and, if desired, a means for sealing the receptacle at the site perforated by the needle or needles.

The invention will be better understood if reference is made to the attached drawings in which FIG. 1 represents a sectional view of the receptacle made of elastomeric material such as KRATON® (hydrogenated, block/triblock, isoprene-styrene rubber) fitted with a pump used for the supply of unit doses of fluid and placed in its support made of plastic, the assembly being installed in a cradle of a filling installation according to the invention.

Figure 1:
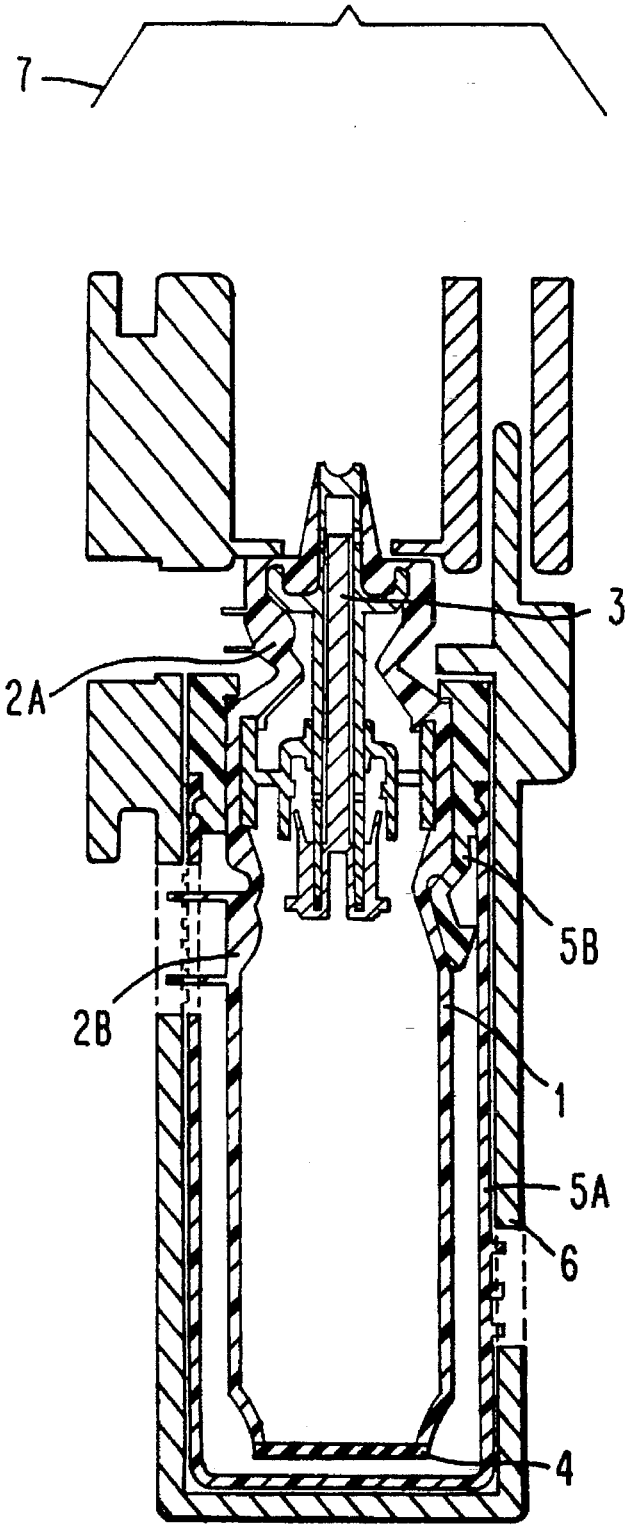

In FIG. 1, the receptacle 1 can be seen, all of it made of a material capable of being pierced by a hollow needle and sufficiently flexible to be able to close itself up again after removal of the hollow needle, here made of KRATON® (hydrogenated, block/triblock, isoprene-styrene rubber), having two parts 2A and 2B specifically designed to be pierced and to close themselves up again more effectively due to their additional thickness.

This receptacle 1, namely an envelope made of KRATON® (hydrogenated, block/triblock, isoprene-styrene rubber), closed at one end by a pump 3 which will subsequently allow the fluid with which said envelope will be filled to be dispensed and at the other end by a seal 4 made by fusion, is contained in a casing having two parts 5A and 5B made of rigid plastic material, which substantially covers said receptacle.

The assembly is maintained, for the purposes of the implementation of the process, in a cradle 6 of a filling unit. The supply of the laminar gas flow has been schematized by 7, which in this example bathes the whole filling unit, needles included; these, situated on the left facing sites 2A and 2B, have not been represented here, but in FIG. 2 in the filling position.

The sterilizing filter used for the laminar gas flow is of the type known by the name "ULPA" having holes of 0.12 micron which provides the flow with the sterility defined by Class 10 of the Federal Standard 209 of the "General Service Administration" of the United States of America, that is to say only allowing through a maximum of about 350 particles of a diameter of less than 0.12 micron per cubic meter.

Figure 2:
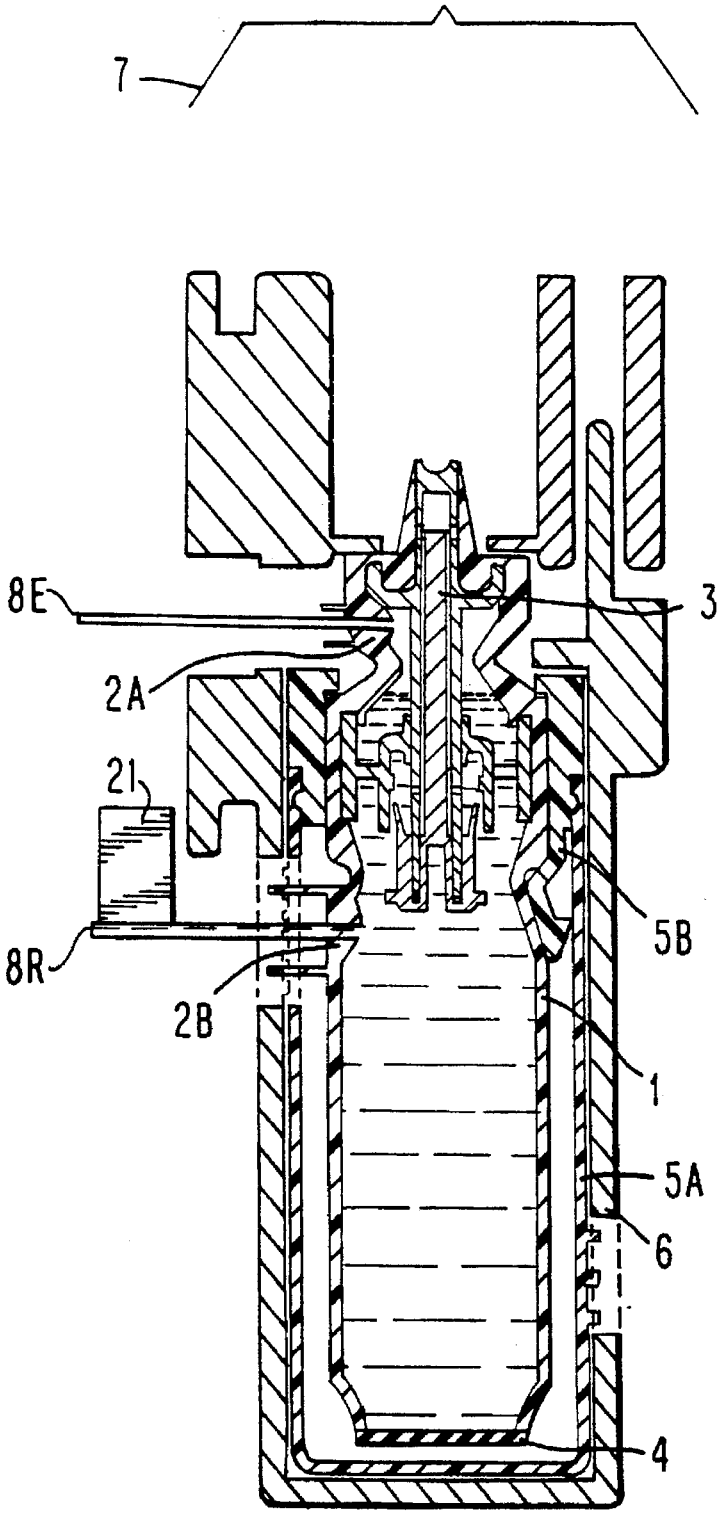
FIG. 2 represents, still under the same conditions, the same elements as well as the injection of the fluid and the evacuation of the fluid already existing in the hermetically sealed bag.

In FIG. 2, two hollow needles, 8R for filling and 8E for evacuation, can be seen which pass through the envelope 1.

The receptacle has, if desired, been subjected before filling to a sterilization, for example by gamma radiation. The introduction of the needles is carried out in the area of the sites where the retention cradle 6 does not obstruct the thick parts 2A and 2B.

If an evacuation stage has been carried out before filling, the part of the elastomeric envelope opposite the pump is flattened before being filled.

This filling stage is preferably carried out on a vibrating table in order to force any bubbles which might be formed during filling to rise to the top of the envelope, facing the evacuation needle.

Here the evacuation of the fluid contained in the envelope closed by the valve and pierced by the hollow needle 8E has firstly been carried out, allowing in particular the evacuation of the fluid found in the various cavities of the pump 3. Filling, which here is partial, has then been carried out, using the hollow needle 8R introduced through the part 2B specifically designed for this purpose.

In the above example, the motorized introduction of the two needles to carry out the penetration was simultaneous, and so was their removal.

It is also seen that the hollow filling needle 8R is situated below the hollow evacuation needle 8E which is introduced near to the top of the envelope.

Figure 3:
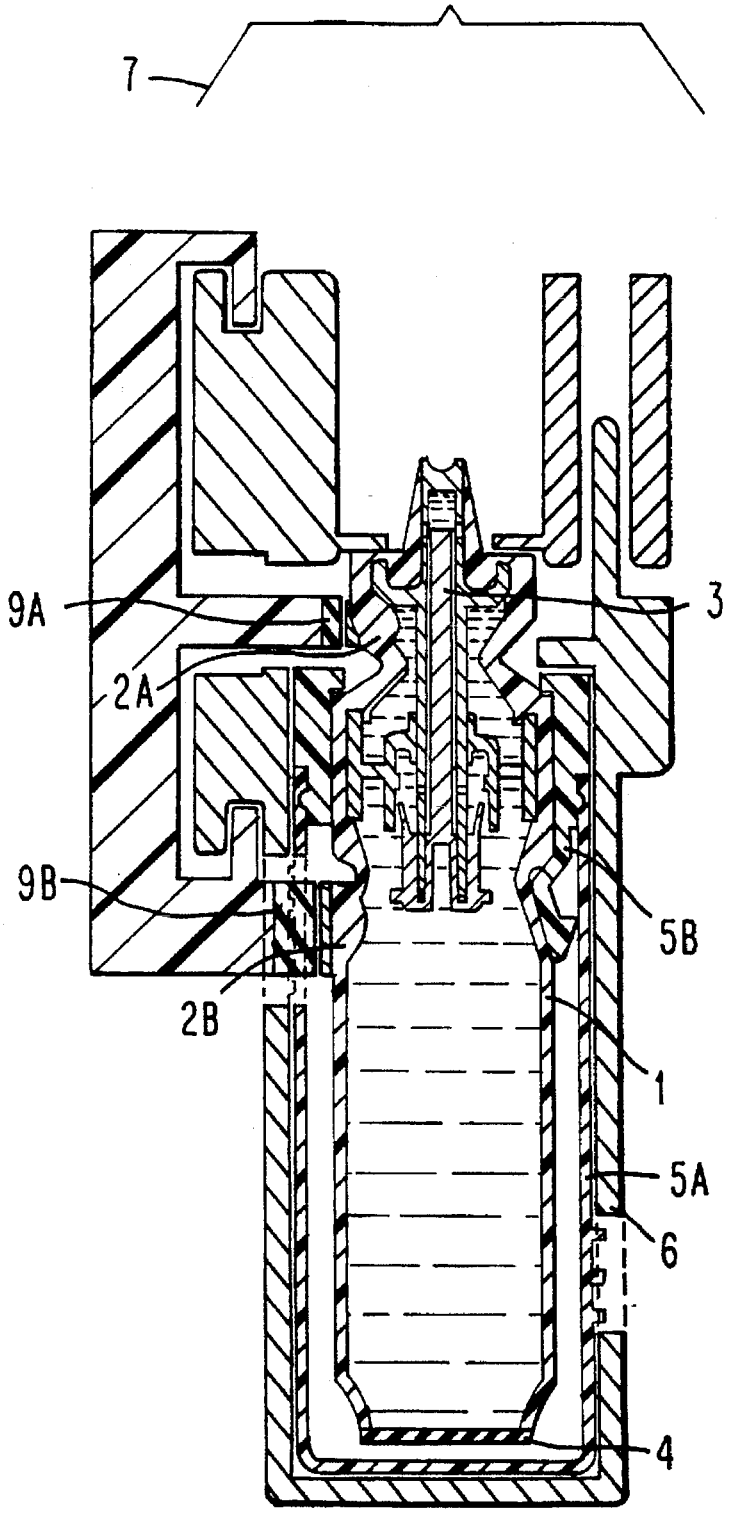
FIG. 3 represents, under the same conditions, the receptacle in its support, the assembly being installed in a cradle of the filling installation whilst the filling and evacuation needles have been removed, and have been replaced by a heating device, which can bring about total sealing by fusion, in the area of the penetration holes.

The removal of the needles is then carried out and if desired the tightness is completed by carrying out sealing operations, in particular by hot fusion, which can be seen in the area of the penetrations in FIG. 3 where the needles have been replaced by heating plugs 9A and 9B which ensure a perfect seal of the penetrations of the envelope by fusion.

This sealing makes the process and the installation of the present invention particularly useful when the receptacle must be stored for a prolonged period of time.

Furthermore, using the same material for all of the envelope makes the process and the installation very competitive in terms of cost.

In FIG. 2 it was seen that the thick parts 2A and 2B were extended via small hollow cylinders. These can advantageously be replaced by a greater thickness, forming a protuberance outside the envelope, such as a hemispherical button.

The heating clamp heads can then be replaced for example by heating plugs, domes or cones.

Furthermore, as a variant, the laminar flow supply could be produced under a hermetic hood with a non-sterile frame, under which all or part of the different operations mentioned above will be carried out. The operating space will in this case only be accessible to the operator by means of sterile gloves.

This variant advantageously enables any temporary deficiency in the laminar flow to be overcome and, if desired, an inert gas to be used for this flow, recirculated after filtration.

In conclusion, the process of the present invention proves to be particularly advantageous in particular in that it requires only a small number of operating stages to produce a filling operation under aseptic conditions.

The result is a process which is inexpensive to implement and which offers maximum safety.

I claim:

1. An automated process for filling a sealed receptacle (1) with a fluid under aseptic conditions, wherein said receptacle is a bag and has at least one part (2B) made of a material capable of being pierced by a hollow needle (8R) actuated by a motorized means and sufficiently flexible to close itself up after removal of the hollow needle, comprising the steps of: piercing said part (2B) with a perforating end of a hollow filling needle (8R) which is connected to the fluid and actuated in a direction of the receptacle by the motorized means; filling the receptacle (1) with fluid; and maintaining the perforating end of the hollow filling needle (8R) under aseptic conditions using a laminar flow (7) during the process.

2. The filling process according to claim 1, wherein the filling fluid is a liquid without preservative.

3. The process according to claim 1, further comprising the step of completing the closure at the site (2A, 2B) perforated by the hollow needle (8R, 8E).

4. A receptacle containing a fluid and filled by the process according to claim 1.

5. An automated process for filling a sealed receptacle (1), with a fluid under aseptic conditions, wherein said receptacle has at least one part (2B) made of a material capable of being pierced by a hollow needle (8R) actuated by a motorized means and sufficiently flexible to close itself up after removal of the hollow needle, comprising the steps of: piercing said part (2B) with a perforating end of a hollow filling needle (8R) which is connected to the fluid and actuated in a direction of the receptacle by the motorized means; filling the receptacle (1) with fluid; and maintaining the perforating end of the hollow filling needle (8R) under aseptic conditions using a laminar flow (7) during the process, wherein the sealed receptacle contains, before filling, another fluid and wherein said part is pierced using a hollow evacuation needle (8E).

6. The filling process according to claim 5, wherein said another fluid is a gas or a mixture of gasses.

7. The filling process according to claim 5, wherein the perforating end of the hollow evacuation needle (8E) is maintained under aseptic conditions during the process.

8. An automated process for filling a sealed receptacle (1) with a fluid under aseptic conditions, wherein said receptacle has at least one part (2B) made of a material capable of being pierced by a hollow needle (8R) and sufficiently flexible to close itself up after removal of the hollow needle comprising the steps of: piercing said part (2B) with a perforating end of a hollow filling needle (8R) which is connected to the fluid; filling the receptacle (1) with fluid; and maintaining the perforating end of the hollow filling needle (8R) under aseptic conditions using a laminar flow (7) during the process;

wherein the sealed receptacle contains, before filling, another fluid end wherein said part is pierced using a hollow evacuation needle (8E), and wherein the hollow evacuation needle (8E) is connected to an evacuation device.

9. An automated process for filling a sealed receptacle (1) with a fluid under aseptic conditions, wherein said receptacle has at least one part (2B) made of a material capable of being pierced by a hollow needle (8R) and sufficiently flexible to close itself up after removal of the hollow needle, comprising the steps of; piercing said part (2B) with a perforating end of a hollow filling needle (8R) which is connected to the fluid: filling the receptacle (1) with fluid; and maintaining the perforating end of the hollow filling needle (8R) under aseptic conditions using a laminar flow (7) during the process; wherein the sealed receptacle is substantially evacuated of gas before filling.

10. An automated process for filling a sealed receptacle (1) with a fluid under aseptic conditions, wherein said receptacle has at least one part (2B) made of a material capable of being pierced by a hollow needle (8R) sufficiently flexible to close itself up after removal of the hollow needle, comprising the steps of: piercing said part (2B) with a perforating end of a hollow filling needle (8R) which is connected to the fluid; filling the receptacle (1) with fluid; maintaining the perforating end of the hollow filling needle (8R) under aseptic conditions using a laminar flow (7) during the process; and completing the closure at the site (2A, 2B) perforated by the hollow needle (8R, 8E); wherein the closure is completed by hot sealing or by using a laser beam.

11. An apparatus for filling a sealed receptacle under aseptic conditions comprising: a motorized hollow filling needle (8R) having a perforating end, a generator of a laminar gas flow (7) active over at least the perforating end of a filling needle (8R), a retention means (6) for retaining a receptacle (1) to be filled with a fluid during filling, motorized means for actuating the hollow filling needle (8R) in the direction of the receptacle (1) for perforating the receptacle, and a supply of filling fluid in fluid communication with the hollow filling needle (8R).

12. The apparatus according to claim 11 further comprising a means (9A, 9B) for sealing the receptacle (1) at a site (2A, 2B) to be perforated by the needle (8R).

13. An apparatus for filling a sealed receptacle under aseptic conditions comprising: a motorized hollow filling needle (8R) having a perforating end, a generator of a laminar gas flow (7) active over at least the perforating end of a filling needle (8R), a retention means (6) for retaining a receptacle (1) to be filled with a fluid during filling, motorized means for actuating the hollow filling needle (8R) in the direction of the receptacle (1) for perforating the receptacle at a first location, a supply of filling fluid in fluid communication with the hollow filling needle (8R), and a motorized hollow evacuation needle (8E) whose movements are synchronized with those of the motorized hollow filling needle (8R) to pierce said receptacle at a second location remote from said first location.

* * * * *

UNITED STATES PATENT AND TRADEMARK OFFICE

CERTIFICATE OF CORRECTION

PATENT NO. : 5,641,004

DATED : June 24, 1997

INVENTOR(S) : PY, Daniel

It is certified that error appears in the above-indentified patent and that said Letters Patent is hereby corrected as shown below:

Column 1, lines 58-59, change "available disposal" to --available--.

Column 4, line 11, change "(H2O2)" to --($H_2O_2$)--.

Column 8, line 20, after "needle" insert --,--.

Column 8, line 28, change "end" to --and--.

Column 8, line 47, after "(8R)" insert --and--.

Signed and Sealed this

Twenty-third Day of June, 1998

Bruce Lehman

*Attest:*

BRUCE LEHMAN

*Attesting Officer*

*Commissioner of Patents and Trademarks*